United States Patent [19]

Simms

[11] 4,007,600

[45] Feb. 15, 1977

[54] ICEBOX CONVERSION UNIT

[76] Inventor: Larry L. Simms, P.O. Box 1083, San Pedro, Calif. 90733

[22] Filed: Apr. 2, 1976

[21] Appl. No.: 672,996

Related U.S. Application Data

[63] Continuation-in-part of Ser. No. 548,601, Feb. 10, 1975, abandoned.

[52] U.S. Cl. ..... 62/3; 62/457

[51] Int. Cl.[2] ..... F25B 21/02; F25D 3/08

[58] Field of Search ..... 62/3, 453, 457

[56] References Cited

UNITED STATES PATENTS

| | | | |
|---|---|---|---|
| 3,012,418 | 12/1961 | Hill | 62/457 |
| 3,018,631 | 1/1962 | Bury et al. | 62/453 |
| 3,412,566 | 11/1968 | Townsend et al. | 62/3 |
| 3,732,702 | 5/1973 | Desch | 62/3 |
| 3,821,881 | 7/1974 | Harkias | 62/3 |
| 3,823,567 | 7/1974 | Corini | 62/3 |

*Primary Examiner*—Lloyd L. King
*Attorney, Agent, or Firm*—Noel B. Hammond

[57] ABSTRACT

A thermoelectric refrigeration unit in which the heat-sink plate and cold plate are separated by spacer blocks, and the space between the plates is filled with thermal insulation. A separator encloses the insulation and the space between the plates and has the fan and power supply mounted to it. A cover encloses the fan, power supply and heat-radiating fins and has openings for circulation of air. The separator and cover are fastened to the cold plate which serves as the base for the unit and as the means for mounting the unit in an insulated enclosure. In a modified embodiment, a shroud and fan assembly is mounted over the cold plate for circulating refrigerated air within the insulated enclosure.

5 Claims, 7 Drawing Figures

Fig. 3.
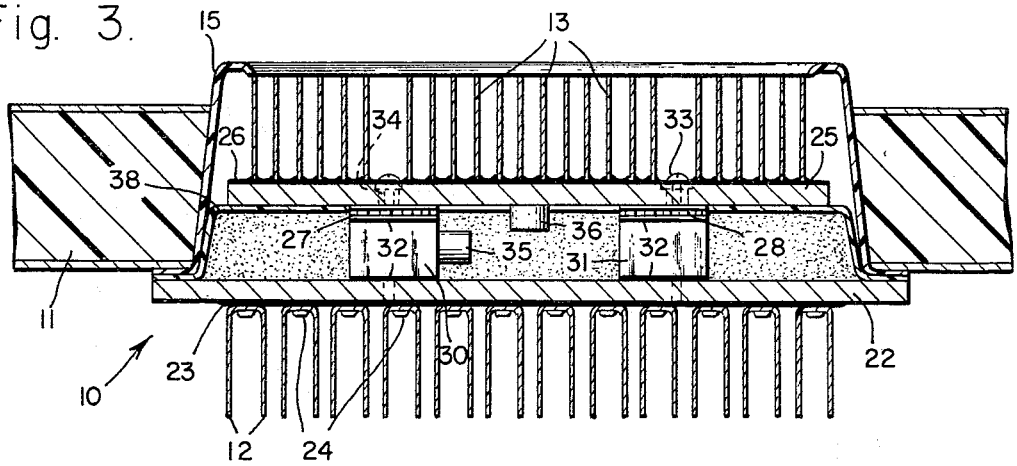
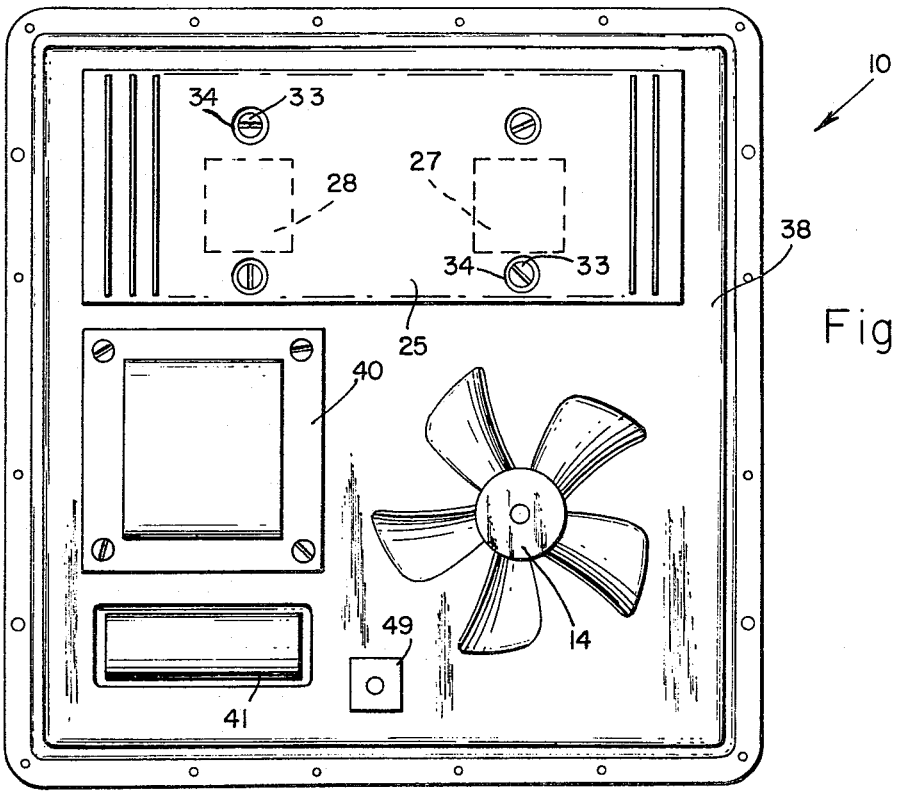
Fig. 4.

Fig. 5.
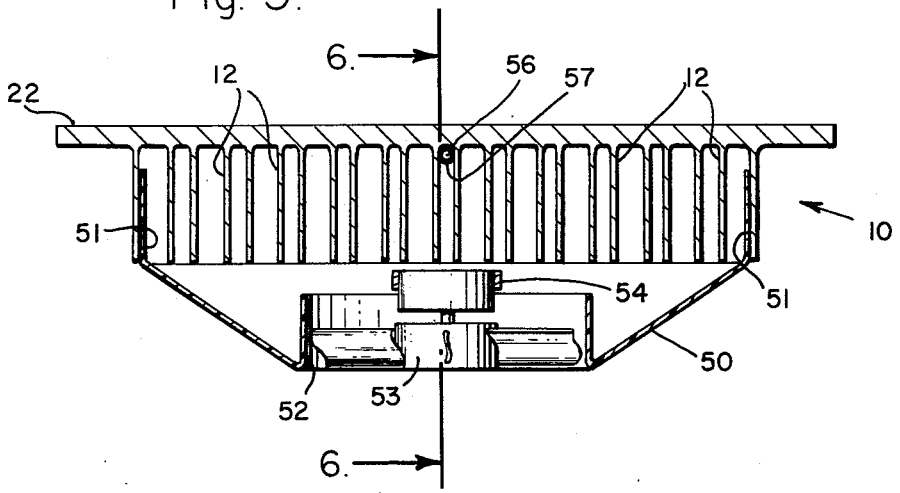
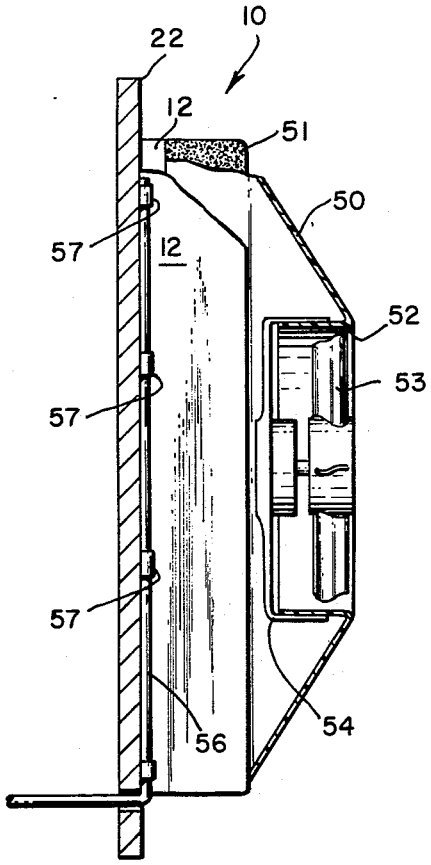
Fig. 6.
Fig. 7.
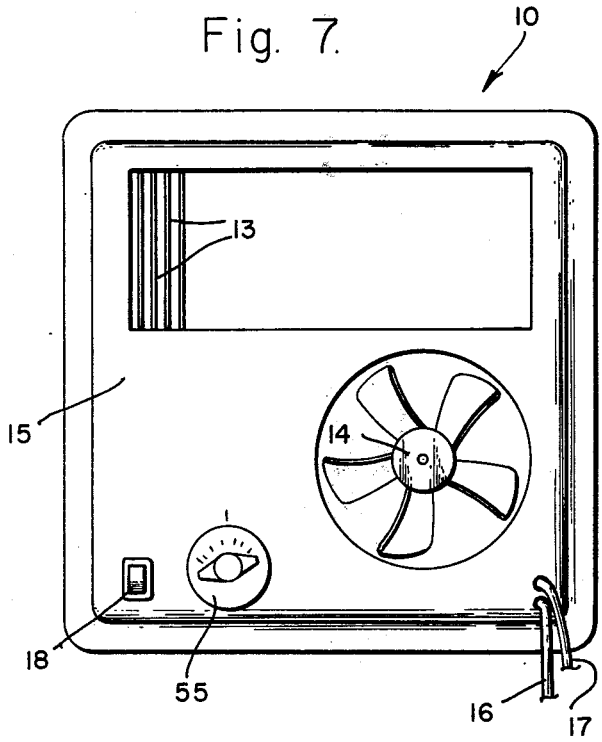

ICEBOX CONVERSION UNIT

BACKGROUND OF THE INVENTION

This is a continuation-in-part of my prior copending application Ser. No. 548,601, filed Feb. 10, 1975, entitled, "Icebox Conversion Unit" now abandoned.

FIELD OF THE INVENTION

This invention relates to refrigeration apparatus, and more specifically to a compact, self-contained thermoelectric refrigeration unit for converting any existing insulated enclosure into an electric refrigerator.

There are many insulated iceboxes or ice chests in use, in which ice is placed to preserve food. Notably, these insulated enclosures for receiving ice find use for picnics and outings in trailers and campers, and aboard boats and airplanes. It is sometimes desirable to replace these iceboxes with electrical refrigerators, but due to space or cost limitation this is not always feasible. Generally, aboard a boat the icebox is a built-in, integral part of the galley, and there is insufficient space to add a refrigerator. Even if the icebox can be removed, a refrigerator generally will not fit in the space formerly occupied by the icebox. Boats are not rectangular and do not have square corners. The icebox may have a curved back wall at the lower corners, whereas refrigerators are generally rectangular and have square corners. For this reason, refrigerators have been strapped into a bunk at times, taking up needed bed space.

One alternative is to convert the icebox to a compressor-type refrigerator employing units similar to those shown in U.S. Pat. Nos. 2,914,927 and 3,712,078. One such compressor-type conversion unit for boat costs about $1,000 installed and has twelve-foot pipes. Another unit available for boats is a cold pump compressor that bolts onto the engine. It cools the plate to −80° or −90° and it will keep the icebox cool for 4 or 5 hours.

Another alternative is to convert the icebox to a refrigerator by installing the cooling unit from a thermoelectric refrigerator. The principles of thermoelectric refrigerators are illustrated in U.S. Pat. Nos. 3,018,631 and 3,100,970. However, commercially available thermoelectric refrigerators do not have the cooling unit as a compact, self-contained refrigeration unit that lends itself to easy installation in an existing insulated enclosure.

U.S. Pat. No. 3,412,566 shows a refrigerator cooled by a thermoelectric unit, but the thermoelectric unit is built as an integral part of the refrigerator. The inner wall of the refrigerator itself serves as the cold plate, and the components of the thermoelectric unit are assembled into the wall of the refrigerator at the time the refrigerator is built, and after the elements are assembled into the wall, the space within the wall is filled with insulation.

Similarly, U.S. Pat. No. 3,821,881 shows a refrigerator having a thermoelectric unit built into the door. The door is of a special shape and configuration, and the components of the thermoelectric unit are assembled into the door at the time it is built, and tightening the assembly effectively clamps the unit into the door. Clearly, such cooling units do not lend themselves to easy installation in an existing insulated enclosure because they are not constructed as fully-assembled, compact, self-contained units which will mount easily in a proper size hole made in any insulated enclosure.

Accordingly, it is an object of the present invention to provide an icebox conversion unit which is simple, compact and self-contained, and in which the entire unit is easily fastened into a hole made in an existing insulated enclosure.

Another object of the invention is the provision of a refrigerator conversion unit which is relatively inexpensive to install and economical to operate.

A further object of the present invention is to provide a refrigerator conversion unit which will operate on any available voltage, AC or DC.

A still further object of the invention is the provision of a refrigerator conversion unit which operates silently, is not sensitive to motion, is light in weight, and can be mounted in the top, bottom, or any side of an existing enclosure because it does not require that any particular side be maintained in an upright position.

SUMMARY OF THE INVENTION

In accordance with these and other objects of the invention, there is provided a compact, self-contained refrigeration unit comprising a thermoelectric assembly, power supply, and fan, all mounted in a case which may be conveniently fastened into a hole in any existing thermally insulated enclosure. The cold plate of the thermoelectric assembly serves as the wall or base, and as the mounting means for the entire unit. An intermediate separator fits over most of the thermoelectric assembly and contains thermal insulating material that insulates the cold plate from the heat-sink plate. The power supply and the fan are mounted to the separator, and a cover fits over all, nesting over the separator. The separator and cover have flanges which are fastened to the cold plate, and the cover has openings to permit the fan to circulate air over the heat-radiating fins. In another embodiment of the invention, a shroud and fan assembly is mounted over the cold plate to circulate the refrigerated air within the insulated enclosure.

BRIEF DESCRIPTION OF THE DRAWINGS

The foregoing and other objects and features of the present invention can be more readily understood with reference to the following detailed description, taken in conjunction with the accompanying drawings, wherein like reference numerals designate like structural elements, and in which

FIG. 3 is a cross-sectional view taken along the lines 3—3 of FIG. 2;

FIG. 4 is a plan view of the refrigeration unit of FIGS. 1–3 with the cover removed, showing the layout of the thermoelectric assembly, fan and power supply on the separator;

FIG. 5 is a cross-sectional view from the top of a portion of another embodiment of the invention showing a modified cold plate fitted with a shroud and fan assembly;

FIG. 6 is a cross-sectional view from the side of the modified embodiment of the invention shown in FIG. 5, taken along the lines 6—6 of FIG. 5; and FIG. 7 is a front view of the cover of the embodiment of FIGS. 5 and 6, showing an adjustable thermostat mounted thereto.

DETAILED DESCRIPTION OF THE INVENTION

Figure 1:
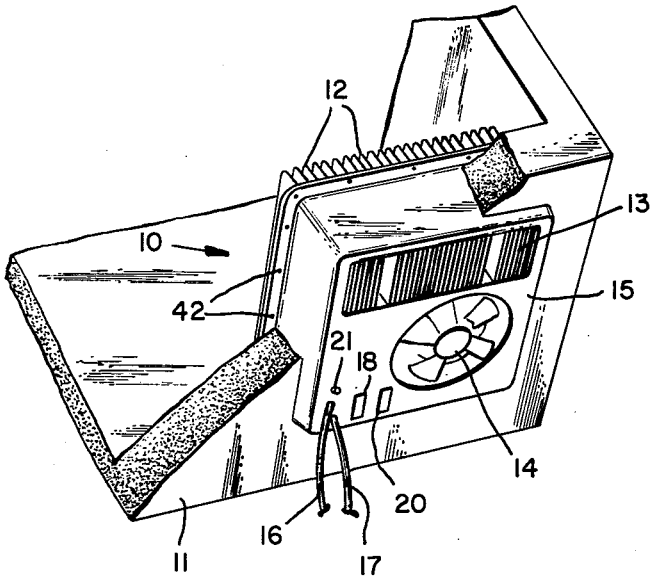
FIG. 1 is a perspective view of a refrigeration unit of the present invention mounted in an insulated enclosure, with the enclosure being shown partly broken away.

Referring now to the drawings, FIG. 1 shows an icebox conversion unit 10 constructed in accordance with the present invention, mounted in a hole provided in an insulated enclosure 11. Heat absorbing fins 12 inside the enclosure 11 absorb heat which is transmitted to heat-radiating fins 13, where air circulated by a fan 14 carries the heat away from the heat-radiating fins 13 through an opening in a cover 15 of the unit 10. An AC power cord 16 and a DC power cord 17 extend out of the unit 10 through holes in the cover 15. Two switches 18, 20 and a pilot light 21 are mounted to the cover 15.

Figure 2:
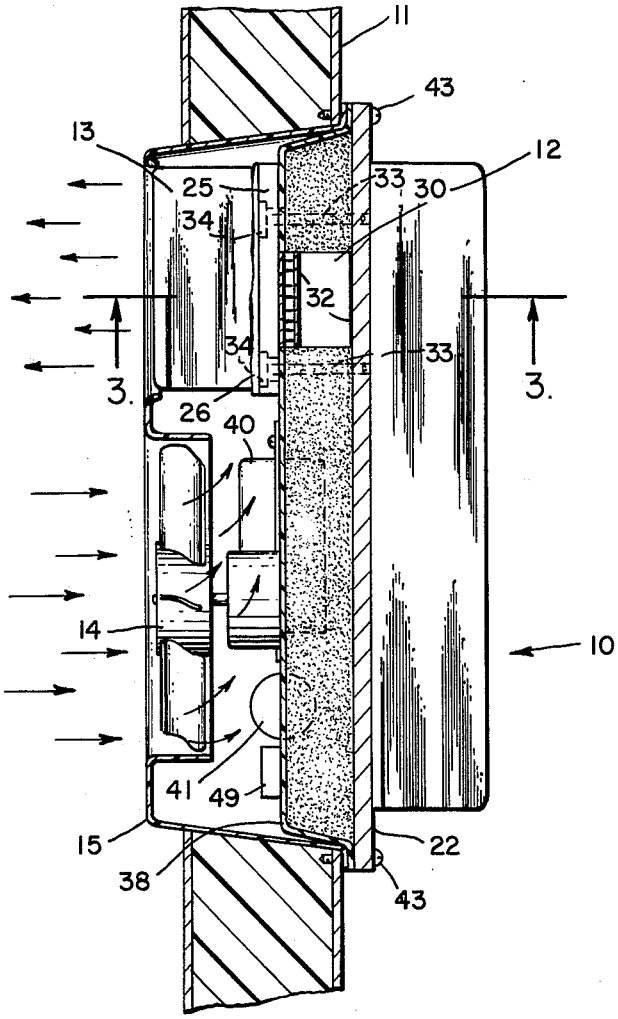
FIG. 2 is a side view in cross-section of the refrigeration unit of FIG. 1.

The interior of the icebox conversion or refrigerator unit 10 is shown in FIGS. 2, 3, and 4. The heat-absorbing fins 12 are made of thermally conductive metal such as aluminum, and are fastened to a cold plate 22 by any conventional means that will make a good thermally conductive joint. The cold plate 22 is also made of a highly conductive metal such as aluminum.

In the present embodiment, there are 12 sets of U-shaped, doubled fins, or 24 heat-absorbing fins, 12 in all. They are made of an aluminum having a roughened surface, known as "stucco pattern" aluminum, to increase the surface area. The heat-absorbing fins 12 are first dipped in a thermally conductive adhesive 23, such as the thermal epoxy made by Emerson and Cuming and identified as Stycast 2850 FT, and then riveted to the cold plate 22 with pop rivets 24. There are two pop rivets 24 for each set of two heat-absorbing fins 12. The thermally conductive adhesive 23 makes the thermal joint, while the pop rivets 24 make the mechanical fastening. Alternatively, the heat-absorbing fins 12 could be dip-brazed to the cold plate 22.

The cold plate 22 has a large surface and is relatively thick, because in addition to conducting heat, it also serves as the wall or base for the refrigerator unit 10, and as the mounting means for mounting the unit 10 in the insulated enclosure 11.

The heat-radiating fins 13 may be made of the same material as the heat absorbing fins 12, and are fastened to a heat-sink plate 25 by any conventional means that makes a good thermally-conductive joint. The heat-sink plate 25 is made of a highly conductive metal, but if it is made of aluminum or the like, it must be copper plated.

In the present embodiment there are 50 heat-radiating fins 13 made of stucco pattern aluminum. The heat-sink plate 25 is made of copper-plated aluminum and the fins 13 are fastened thereto by a layer of thermally conductive adhesive 26, such as Stycast 2850 KT. A layer ⅛-inch thick of adhesive 26 is spread on the surface of the plate 25 and the fins 13 are sunk into the adhesive 26, which then hardens to mechanically and thermally bond the fins 13 to the plate 25. If desired, several holes may be drilled through the heat-sink plate 25 and countersunk on the opposite side so that the adhesive 26 may pass through the holes and spread like a rivet on the other side to form a lock.

Two thermoelectric modules 27, 28 are soldered directly to the other side of the heat-sink plate 25. The thermoelectric modules 27, 28 may be of the type sold by Melcor of Trenton, N.J., and identified as the CP Series Ceramic Module. In the present embodiment two thermoelectric modules 27, 28 are sufficient to refrigerate an insulated enclosure 11 of up to about five cubic feet, but for larger enclosures more modules may be added. The thermoelectric modules 27, 28 are soldered to the heat-sink plate 25 because an extremely high efficiency is needed on the hot side.

Two thermally conductive spacer blocks 30, 31 are placed between the other side of the thermoelectric modules 27, 28 and the cold plate 22. A thin continuous film of a thermally conductive compound 32, such as thermal grease identified as Wakefield Engineering Type 120 or Dow Type 340, is put on each end of the spacer blocks 30, 31 to make good conductive joints to the cold plate 22 and the modules 27, 28. Alternatively, one of the joints may be made using a thermal adhesive such as Stycast 2850 FT.

The thermoelectric module assembly is held together by screws 33 which pass through fiber shoulder washers 34 and oversize holes in the heat-sink plate 25 and into tapped holes in the cold plate 22. The screws 33 pass adjacent to the modules 27, 28 and are torqued evenly to a predetermined value so as not to distort the surfaces of the thermally conductive junctions. The spacer blocks 30, 31 are held in place by the compression produced by the screws 33. A gap is left between the heat-radiating fins 13 to permit the passage of the screws 33.

Two thermostats 35, 36 are provided in the thermoelectric module assembly, and are of a type having a fixed predetermined setting, such as those made by Texas Instruments. One thermostat 45 is the temperature control thermostat and is fastened to one of the spacer blocks 30. It turns the unit 10 off at nominally 32° and back on at nominally 47°. The other thermostat 36 is a protective thermostat and is fastened directly to the heat-seat plate 25. If the air flow stops and the heat-sink plate 25 begins to warm up, the protective thermostat 36 shuts off the unit 10 when the heat-sink plate 25 reaches a temperature of 140°. The thermostats 35, 36 may be fastened down with thermally-conductive adhesive, and are wired to control the power to the fan 14 as well as to the thermoelectric modules 27, 28.

Thermal insulating material 37, such as compressible spongy urethane foam, is disposed between the heat-sink plate 25 and the cold plate 22. Alternatively, the thermal insulating material 37 may be pour-in-place foam or a molded rigid foam insert. The pour-in-place foam may be freon-blown polyurethane foam of about 1½ pounds density. Furthermore, one or more layers of aluminized Mylar film may also be disposed between the heat-sink plate 25 and the cold plate 22, if desired, and it is particularly useful when placed between the cold plate 22 and the insulating material 37. There is a tendency for moisture to condense on the back side of the cold plate 22, and one or more layers of aluminized Mylar film act as a moisture barrier and tend to prevent condensation. However, when pour-in-place foam insulation is used, condensation does not occur, because air is excluded.

The insulating material 27 is provided with an opening to accommodate the thermoelectric modules 27, 28 and the spacer blocks 30, 31. An intermediate separator 38 extends from a flange which contacts the edge of the cold plate 22 to a dished configuration which covers the insulating material 37 and passes beneath the heat-sink plate 25. The separator 38 has an opening through which passes the thermoelectric modules 27, 28 and the spacer blocks 30, 31. The separator 38 may be made of vacuum-formed plastic.

The fan 14 and the power supply are fastened to the separator 38. The AC power supply is comprised of a transformer 40, a bridge rectifier 49 and a capacitor 41 for a capacitor input filter. The transformer 40 and the capacitor 41 may be recessed into the separator 38. If desired, the AC power supply may be replaced by an external power converter.

The cover 15 is of a dished configuration and nests over the separator 38. It has a flange in contact with the flange of the separator 38, and the whole assembly is fastened together by any suitable means, such as pop rivets 42 which fasten the flanges of the separator 38 and cover 15 to the cold plate 22. The cover 15 has an opening for the entry of air over the fan 14, and an opening for the exhaust of air over the heat-radiating fins 13. The cover 15 may be made of vacuum-formed plastic.

The primary of the transformer 40 is connected to the AC power cord 16, and the secondary is connected to the bridge rectifier 49. The power switch 18 is a single pole double-throw switch, and when it is in the "AC on" position, it connects the output of the rectifier 49 to the filter capacitor 41 and through the two thermostats 35, 36 to the thermoelectric modules 27, 28 and the fan 14.

When the power switch 18 is in the "DC on" position, the DC line cord 17 is connected through the switch 18 and the two thermostats 35, 36 to the thermoelectric modules 27, 28 and the fan 14. The unit 10 can be made to operate from any conventional AC or DC power source.

As an energy-saving feature, the other switch 20 is connected in parallel with the temperature control thermostat 35 so that it can be switched out of the circuit as desired. Thus, the unit 10 can operate either continuously or intermittently.

Referring now to FIGS. 5, 6, and 7, another embodiment of the refrigeration unit 10 has the cold plate 22 and the heat-absorbing fins 12 made integrally as an aluminum extrusion. A shroud 50, which may be made of vacuum-formed plastic, is disposed over the heat-absorbing fins 12. The vertical sides of the shroud 50 are fastened to the inner sides of the two outside heat-absorbing fins 12 by adhesive means 51, which may be double-sided urethane tape, epoxy cement or the like. The shroud 50 is open at the top and the bottom.

The shroud 50 is provided with a central opening 52 for a fan 53 which is mounted therein by means of a bracket 54. The fan 53 draws air into the shroud 50 through the central opening 52, past the heat-absorbing fins 12, and blows the air out the top and bottom of the shroud 50. This circulates the air in the insulated enclosure 11.

Instead of the fixed thermostat 35 having a fixed predetermined setting, this embodiment of the refrigeration unit 10 is provided with an adjustable thermostat 55 which is mounted to the cover 15. The adjustable thermostat 55 has a temperature-sensing tube 56 which passes through the cold plate 22 and extends along between two of the heat-absorbing fins 12. The tube 56 may be held in place by four U-shaped metal clips 57 which snap in between the fins 12.

To install the unit 10, a hole of the proper size is cut in an existing insulated enclosure 11, and the unit 10 is mounted in the hole from the inside by means of four screws 43 which pass through the cold plate 22 and the flanges of the separator 38 and the cover 15 into the wall of the insulated enclosure 11.

The refrigeration unit 10 is a simple, compact and self-contained unit, so that the entire unit 10 fits within the insulated enclosure 11. It can be easily installed by an unskilled person.

The refrigeration unit 10 is inexpensive to buy and economical to operate, and it is silent in operation. It is not sensitive to motion and does not need to be oriented with any particular side up. It can be mounted in the top, bottom, or any side of any insulated enclosure.

The refrigeration unit weighs 10½ pounds, and its size is 10 × 10 × 6½. Current drain when operating on 12 volts DC is 3.8 amperes, and when operating on 115 volts AC it is 0.5 amperes. The unit mounts in a hole 8⅝ inches wide and 8⅞ inches high. It will cool a 5 cubic foot or smaller fully insulated ice chest, and will cause freezing in a 2 cubic foot or smaller ice chest. By setting the thermostat to 55° (or any other desired temperature) it may be used to maintain a wine storage cabinet at a desired temperature.

It is to be understood that the above-described embodiments of the invention are merely illustrative of the many possible specific embodiments which represent applications of the principles of the present invention. Numerous and varied other arrangements can be readily devised in accordance with these principles by those skilled in the art without departing from the spirit and scope of the invention.

What is claimed is:

1. A compact, self-contained refrigeration adapter unit for installation in any existing insulated enclosure comprising:

a heat-sink plate with heat-radiating fins on one side thereof, a cold plate with heat-absorbing fins on one side thereof and defining a base and mounting means for said refrigeration adapter unit, a thermoelectric module disposed between said plates, a fan disposed for circulating air past said heat-radiating fins, means for energizing said module and said fan, thermal insulation material disposed between said plates to substantially completely fill the space therebetween, an intermediate separator disposed to substantially enclose the space between said plates, said separator having a flange in contact with the edge of said cold plate, said separator extending to cover said insulation material and pass beneath said heat-sink plate, said separator having an opening for said module to pass through, a cover disposed to nest over said intermediate separator and extend to enclose said fan and said heat-sink plate and said heat-radiating fins, said cover having a flange in contact with the flange of said separator, said cover having openings over said fan and over said heat-radiating fins to permit the circulation of air, fastening means for fastening the flanges of said separator and said cover to said cold plate to form a compact, self-contained refrigeration adapter unit, and means for mounting said cold plate and the associated refrigeration adapter unit in an aperture in an existing insulated enclosure.

2. The apparatus of claim 1 in which a shroud is disposed over said heat-absorbing fins, said shroud having a central opening with a fan disposed therein, said shroud having openings at the sides to permit the circulation of refrigerated air inside said enclosure, the air entering said shroud through said central opening and leaving through said openings at the sides thereof.

3. The apparatus of claim 2 in which a protective thermostat is fastened to said heat-sink plate for de-energizing said apparatus when the temperature of said heat-sink plate exceeds a predetermined value.

4. The apparatus of claim 3 in which a temperature control thermostat is coupled to said cold plate for sensing the temperature thereof to control the operation of said refrigeration adapter unit.

5. The apparatus of claim 4 in which a switch is connected to said temperature control thermostat for permitting the selection of intermittent or continuous operation.

* * * * *